US006153976A

United States Patent [19]

Spanjers

[11] Patent Number: 6,153,976

[45] Date of Patent: Nov. 28, 2000

[54] PULSED PLASMA THRUSTER WITH ELECTRIC SWITCH ENABLING USE OF A SOLID ELECTRICALLY CONDUCTIVE PROPELLANT

[75] Inventor: Gregory G. Spanjers, Helendale, Calif.

[73] Assignee: The United States of America as represented by the Secretary of the Air Force, Washington, D.C.

[21] Appl. No.: 09/244,546

[22] Filed: Feb. 4, 1999

[51] Int. Cl.[7] ..... H01J 7/24

[52] U.S. Cl. ..... 315/111.21; 60/203.1; 60/253

[58] Field of Search ..... 60/203.1, 253, 60/200.1; 315/111.21, 111.31; 313/547, 550, 551

[56] References Cited

U.S. PATENT DOCUMENTS

| | | | |
|---|---|---|---|
| 3,636,709 | 1/1972 | LaRocca | 60/203 |
| 4,548,033 | 10/1985 | Cann | 60/203.1 |
| 4,577,461 | 3/1986 | Cann | 60/203.1 |
| 4,821,509 | 4/1989 | Burton et al. | 60/203.1 |
| 4,937,456 | 6/1990 | Grim et al. | 315/111.31 |
| 5,924,278 | 7/1999 | Burton et al. | 60/203.1 |
| 5,947,421 | 9/1999 | Beatitie et al. | 60/202 |

*Primary Examiner*—Don Wong
*Assistant Examiner*—Thuy Vinh Tran
*Attorney, Agent, or Firm*—William G. Auton

[57] ABSTRACT

An energy storage capacitor after being charged, is discharged across an electrically conductive solid propellant by means of a movable electrode contacting the propellant, and the resulting direct ohmic heating of the face of the propellant results in impulse producing vaporization thereof.

8 Claims, 1 Drawing Sheet

PULSED PLASMA THRUSTER WITH ELECTRIC SWITCH ENABLING USE OF A SOLID ELECTRICALLY CONDUCTIVE PROPELLANT

STATEMENT OF GOVERNMENT INTEREST

The present invention may be made by or for the Government for governmental purposes without the payment of any royalty thereon.

BACKGROUND OF THE INVENTION

There is a need for improved plasma thrust generators or thrusters for controlling the orientation and maneuvering of small power-limited satellites in space of 100 watts or less. These small satellites are expected to be widely used for Air Force and commercial applications. Such attitude control thrusters should be packaged in small lightweight containers and be highly efficient so as to employ small amounts of power, typically less than 100 watts.

Pulsed power thrusters (PPTs) are presently commercialized for use on small power limited satellites which employ solid inert propellants such as "Teflon" polymer. An energy storing capacitor, charged up in about a second, is rapidly discharged in about 10 microseconds at high instantaneous power to vaporize the propellant and produce thrust. The solid propellant eliminates the engineering complexity associated with prior art gaseous propellants, and is converted to vapor and is partially ionized by a surface discharge. Acceleration is accomplished by a combination of thermal and electromagnetic forces to create usable thrust.

The problem with these prior art PPTs is that typical thrust efficiencies for flight models are generally about ten percent or less. The low thrust efficiency is attributable to both low propellant efficiency and low energy efficiency. Further research has shown that energy used to create the magnetic field that accelerates the plasma is poorly used, and significant resistive diffusion of the magnetic field into the plasma is observed. The magnetic energy associated with this field is diffused into the plasma as heat, creating minimal thrust through thermal acceleration.

Propellant conversion is initiated through a surface discharge, and sustained through soft X-ray deposition from the plasma arc, initiated by a sparkplug igniter, and a significant portion of the resulting radiative energy is deposited too deep in the propellant to be used in the discharge. This energy preheats the propellant bar and decreases the propellant efficiency, and energy used to break the strong bonds of the Teflon polymer is unavailable to produce thrust. Also, the mass and energy of the igniter circuit decreases energy efficiency and increases dry mass. Additionally, the plasma component in the PPT has an excessive velocity, and it would be preferable to increase the mass of the plasma component to increase thrust, at the expense of exhaust velocity.

Thus, it is desirable to provide a more capable, low mass, thruster of less than 100 watts, and at reduced cost. It is also desirable to provide a thruster consuming less propellant for a given satellite maneuver.

SUMMARY A PREFERRED EMBODIMENT OF THE INVENTION

The improved pulse generator of the invention eliminates the prior art spark plug igniter, and converts a solid electrically conductive propellant to vapor through direct ohmic heating. A mechanical switch, including a movable electrode, briefly contacts a face of the electrically conductive propellant only after a capacitor of a capacitor type voltage source is charged over a time period of about a second or so. Thus, failures associated with carbonization of the propellant face, which can short the electrodes, are avoided. Since heating is ohmic, the heat deposition depth can be controlled by adjusting he current skin depth by varying the capacitor discharge frequency or propellant resistance. Carbon is an acceptable propellant and heavier materials such as barium or lead can be employed to increase the accelerant mass to increase the thrust, while beneficially decreasing the exhaust velocity.

BRIEF DESCRIPTION OF THE DRAWINGS

Other features of the invention will become more apparent upon study of the following description, taken in conjunction with the sole FIGURE, schematically showing an embodiment of the invention.

DETAILED DESCRIPTION OF A PREFERRED EMBODIMENT OF THE INVENTION

Figure 1:
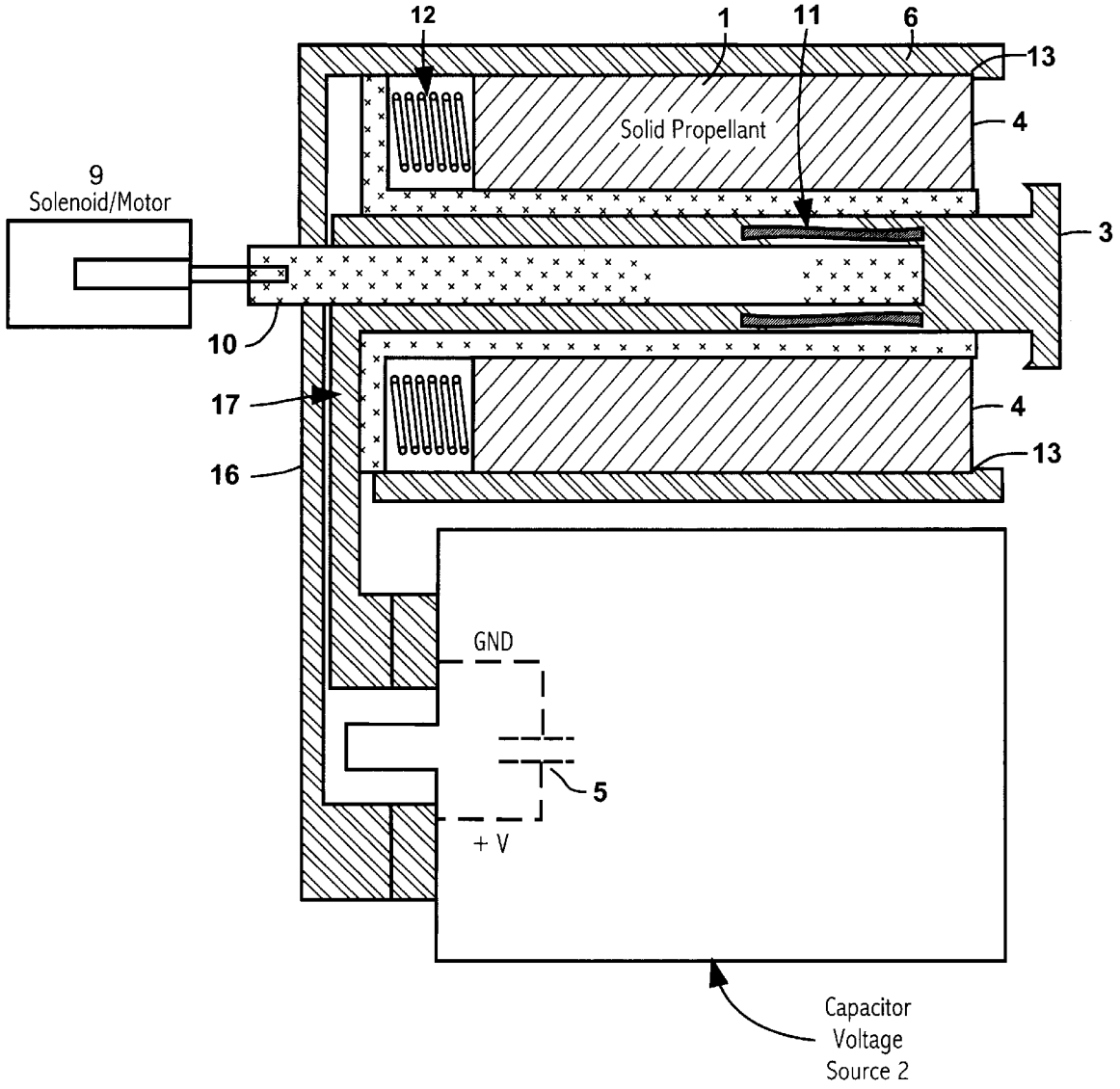

The thrust generator of the present invention can use a coaxial design having an annular solid propellant bar 1, of an electrically conductive propellant such as carbon. An adjustable time constant capacitor type voltage source 2 can be provided, having a capacitor 5 which is charged in about a second, to a voltage sufficient to cause ohmic heating and vaporization of the propellant during the rapid capacitor discharge period, which can be about ten microseconds. After the capacitor is fully charged, movable cathode electrode 3 is displaced to the left by solenoid/motor unit 9 to make contact with face 4 of the propellant, and current flows to the annular anode 6 to produce the heating and vaporization needed to create the desired impulse thrust. The current penetrates into the propellant face, is limited by skin depth effects, and may be varied if desired.

The depth of current penetration into the face of the propellant, and thus the localized ohmic heating, may be beneficially varied by a change in the discharge frequency of the adjustable capacitor type voltage source 2, or by changing the conductivity of the propellant. The resulting ohmic heating quickly increases the propellant temperature to transform the conductive propellant to a vapor. Pressure near the face of the propellant increases to the Paschen minimum, and the breakdown transfers to the vapor, ionizing the vapor to plasma. The plasma can be accelerated in the manner known by those skilled in this art, by the Lorentz force to create the thrust.

The thruster can be operated in either a single-shot or a continuous mode by changing the control mode of solenoid/motor actuator means 9, which can take numerous configurations familiar to those skilled in the electro-mechanical arts. For dedicated single shot operation, required for attitude control, a solenoid pulls the movable electrode 3 to the left via elongated insulator member 10, to produce the ohmic heating. The capacitor voltage can be applied to movable cathode 3 via a flexible conductive braid 11 to initiate capacitor discharge. Feed springs 12 are provided to bias the annular propellant bar against ledge portion 13 of annular anode 6. The capacitor voltages can be applied by means of stripe line conductors 16 and 17 as indicated. Hence, for dedicated single shot applications, cathode 3 can be controlled by a solenoid, servo, or stepping motor, whereas for continuous operation, the electrode can be translated by a motor to be oscillated to repetitively drive the electrode into and out of contact with the propellant face 4, creating a series of thrust impulses. These implementations are of course all within the skill of workers in the art, and thus need not be explained in greater detail. Energy dissipated in the illustrated sliding-contact switch contributes to the total discharge energy, and such can be eliminated by providing a fixed electrode and a semiconductor switch in series with the capacitor 5, to do away with the moving of electrode 3.

Regarding the propellant material, one of our prototypes was designed to use carbon, but heavier materials such as barium or lead would increase the accelerant mass that could decrease excessive exhaust velocity and yet increase thrust. However, it is believed that virtually any electrical conductor could be used, including elements or compounds, and mixtures thereof.

Variations of the foregoing will readily occur to skilled workers in the art and thus the scope of the invention is to be limited solely by the terms of the following claims and art recognized equivalents thereto.

What is claimed is:

1. In a thruster particularly well adopted for use in a small space satellite the improvement comprising:

(a) a solid propellant body made of an electrically conductive material;

(b) electrode means for directly applying voltage pulses across a portion of said solid propellant body sufficient to cause ohmic heating therein capable of vaporizing said solid propellant; and (c) a capacitor type voltage source coupled to said electrode means and having an energy storage capacitor charged during a charge-up period for producing said voltage pulses, and wherein said electrode means includes actuator means for mechanically displacing a movable electrode member of said electrode means into contact with said solid propellant body after charge-up of said energy storage capacitor.

2. The thruster of claim 1 wherein said solid propellant body has an annular shape and is in contact with an outer cylindrical electrode, and said movable electrode member is displaced along a central axis contained within said solid propellant body.

3. The thruster of claim 2 wherein said solid propellant body is made of an electrically conductive material selected from the group consisting of carbon, and material having atomic weights heavier than carbon.

4. The thruster of claim 2 wherein said solid propellant body is made of an electrically conductive material selected from the group consisting of carbon, barium and lead.

5. The thruster of claim 3 wherein said solid propellant body is made of an electrically conductive material selected from the group consisting of carbon, barium and lead.

6. The thruster of claim 1 wherein said solid propellant body is made of an electrically conductive material selected from the group consisting of carbon, and material having atomic weights heavier than carbon.

7. The thruster of claim 6 wherein said solid propellant body is made of an electrically conductive material selected from the group consisting of carbon, barium and lead.

8. The thruster of claim 1 wherein said electrode means includes a non-movable solid state switch for applying said voltage across a portion of said solid propellant body.

* * * * *